US008887931B2

(12) United States Patent
Awalt

(10) Patent No.: US 8,887,931 B2
(45) Date of Patent: Nov. 18, 2014

(54) PRODUCE DISPLAY STAND

(71) Applicant: Terry Awalt, Dedham, ME (US)

(72) Inventor: Terry Awalt, Dedham, ME (US)

(73) Assignee: JSI Store Fixtures, Inc., Milo, ME (US)

( * ) Notice: Subject to any disclaimer, the term of this patent is extended or adjusted under 35 U.S.C. 154(b) by 51 days.

(21) Appl. No.: 13/801,080

(22) Filed: Mar. 13, 2013

(65) Prior Publication Data

US 2014/0263118 A1 Sep. 18, 2014

(51) Int. Cl.
*A47F 3/14* (2006.01)
*A47J 47/00* (2006.01)
*A47F 7/00* (2006.01)

(52) U.S. Cl.
CPC ..... *A47F 7/0071* (2013.01)
USPC ..... 211/85.4; 211/126.1

(58) Field of Classification Search
CPC ..... A47F 5/108
USPC ..... 211/85.4, 59.4, 126.1, 183, 134, 153, 211/135, 72, 73, 133.6; 312/126, 128; 206/561, 557; 220/507, 553, 557
See application file for complete search history.

(56) References Cited

U.S. PATENT DOCUMENTS 62,368 A * 2/1867 Salmon ..... 211/70.6
710,093 A * 9/1902 Brand ..... 206/561
1,646,573 A * 10/1927 Buzza ..... 40/534
1,917,735 A * 7/1933 Roberts ..... 211/85.12
1,973,194 A * 9/1934 Allan ..... 206/521.3
2,010,437 A * 8/1935 Nuyts ..... 206/521.6
2,722,719 A * 11/1955 Altstadter ..... 264/155
3,233,744 A * 2/1966 Ripps ..... 211/119.009
3,407,939 A * 10/1968 Villar-Kelly ..... 211/90.01
3,790,063 A * 2/1974 Moller ..... 206/521.9
3,850,296 A * 11/1974 Hirata et al. ..... 206/711
3,939,987 A * 2/1976 Bustos et al. ..... 211/134
D303,218 S * 9/1989 Long, Jr. ..... D9/456
5,381,896 A * 1/1995 Simons ..... 206/370
5,640,821 A * 6/1997 Koch ..... 52/698
5,641,061 A * 6/1997 de Muylder-Braun ..... 206/6.1
5,680,929 A * 10/1997 Von Seidel ..... 206/77.1
D453,995 S * 3/2002 Slight ..... D3/304
6,648,154 B2 11/2003 Awalt
6,872,338 B2 3/2005 Awalt
7,128,000 B2 * 10/2006 Mummert ..... 108/92
7,249,746 B2 7/2007 Awalt
7,533,770 B2 * 5/2009 Lan ..... 206/308.1
8,162,156 B1 * 4/2012 Crisman ..... 211/85.6
2007/0272630 A1 * 11/2007 De Luca ..... 211/11
2008/0121563 A1 * 5/2008 Polvere et al. ..... 206/763

* cited by examiner

*Primary Examiner* — Joshua Rodden
*Assistant Examiner* — Kimberley S Wright
(74) *Attorney, Agent, or Firm* — Anthony D. Pellegrini

(57) ABSTRACT

A monolithic display stand for the point-of-sale display of produce manufactured out of a closed cell foam material and of solid construction, with a raised central region and vertically oriented divider panels. The display stand is used in a retail setting by first being placed onto a table or other means of support, and then having produce placed onto the top surface, among and between the divider panels. The divider panels hold the produce onto the device, with the raised central region providing a visually pleasing support for the produce, while the foam construction of the stand protects the produce from damage.

6 Claims, 6 Drawing Sheets

PRODUCE DISPLAY STAND

BACKGROUND OF THE INVENTION

1. Technical Field

The present invention relates generally to retail display devices for the point-of-sale display of produce and, more particularly, to a produce display stand constructed out of closed cell foam to support and protect produce while creating an aesthetically pleasing display.

2. Description of Prior Art

Produce display stands are well known in the industry. Conventional display stands are constructed of multiple components involving a labor-intensive manufacturing process. In addition, because of the multiple components, seams, joints, gaps, and other structures are of necessity utilized, providing access points to water, mold, and bacteria, which can damage the produce. The device claimed herein seeks to reduce these deficiencies.

It is therefore an objective of the present invention to provide a produce display stand that is monolithic in construction.

It is a further objective of the present invention to provide a produce display stand that does not contain seams, joints, or gaps.

It is yet a further objective of the present invention to provide a produce display stand that is impervious to water, mold, and bacteria.

It is yet a further objective of the present invention to provide a produce display stand that protects the produce placed thereon from bruising.

It is yet a further objective of the present invention to provide a produce display stand that displays the produce placed thereon in an aesthetically pleasing manner.

It is yet a further objective of the present invention to provide a produce display stand that is simple to manufacture.

It is yet a further objective of the present invention to provide a produce display stand that is light weight and easy to ship.

Other objectives of the present invention will be readily apparent from the description that follows.

SUMMARY OF THE INVENTION

In one aspect, the invention is directed to a device for displaying produce, comprising a monolithic display member constructed of a closed cell foam material, such as closed cell pvc foam, with the top surface being upwardly inclined from front to center and from rear to center, producing a substantially convex top surface onto which produce is placed. Placed across the top surface are vertically oriented divider panels, each panel extending laterally from side to side. The panels serve to retain the produce onto the top surface of the display device while also providing for retention means for keeping produce dispersed among a front region, one or more central regions, and a rear region of the top surface of the display device.

This aspect may include one or more of the following features: the display member has two or more divider panels; the display member has four divider panels; the divider panels are oriented substantially parallel to each other; each divider panel is substantially the same width as each other divider panel; each divider panel is substantially the same thickness as each other divider panel; each divider panel extends from the left edge of the display member to the right edge of the display member; one divider panel is located substantially along the front edge of the display member, one panel is located substantially along the rear edge of the display member, and the remaining panels are located between the first two divider panels and spaced apart from them and from each other; the section of the top surface of the display member located between the front adjacent pair of divider panels is larger in area than the section of the top surface of the display member located between the rear adjacent pair of divider panels; the section of the top surface of the display member located between the front adjacent pair of divider panels is larger in area than all other sections of the top surface of the display member located between all other adjacent pairs of divider panels; each section of the top surface of the display member located between each adjacent pair of divider panels is substantially planar; each section of the top surface of the display member located between each adjacent pair of divider panels is curved smoothly upward; the top edge of each divider panel is rounded; the left and right sides of the display member are substantially parallel; the front and rear sides of the display member are substantially parallel; each lateral side of the display member is substantially perpendicular to each other lateral side to which it is adjacent; and the display member has a width of between forty inches and fifty inches, a depth of between forty inches and fifty-five inches, and a height of between four inches and six inches.

Other features and advantages of the invention are described below.

DETAILED DESCRIPTION OF INVENTION

Figure 1:
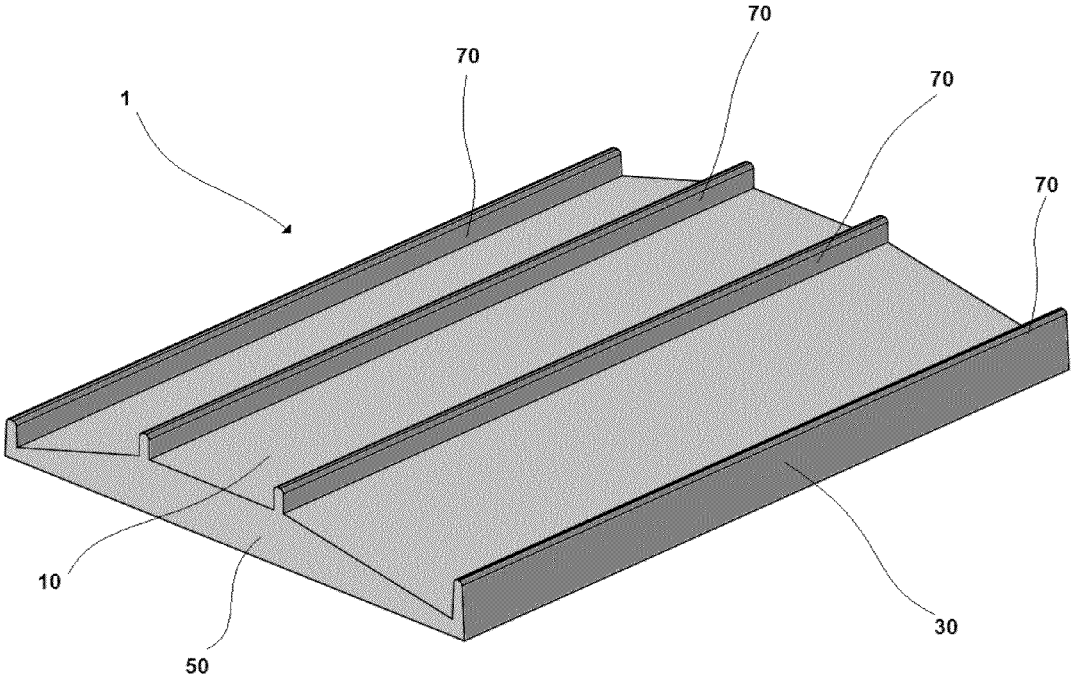
FIG. 1 is a perspective top view of the display member.
Figure 6:
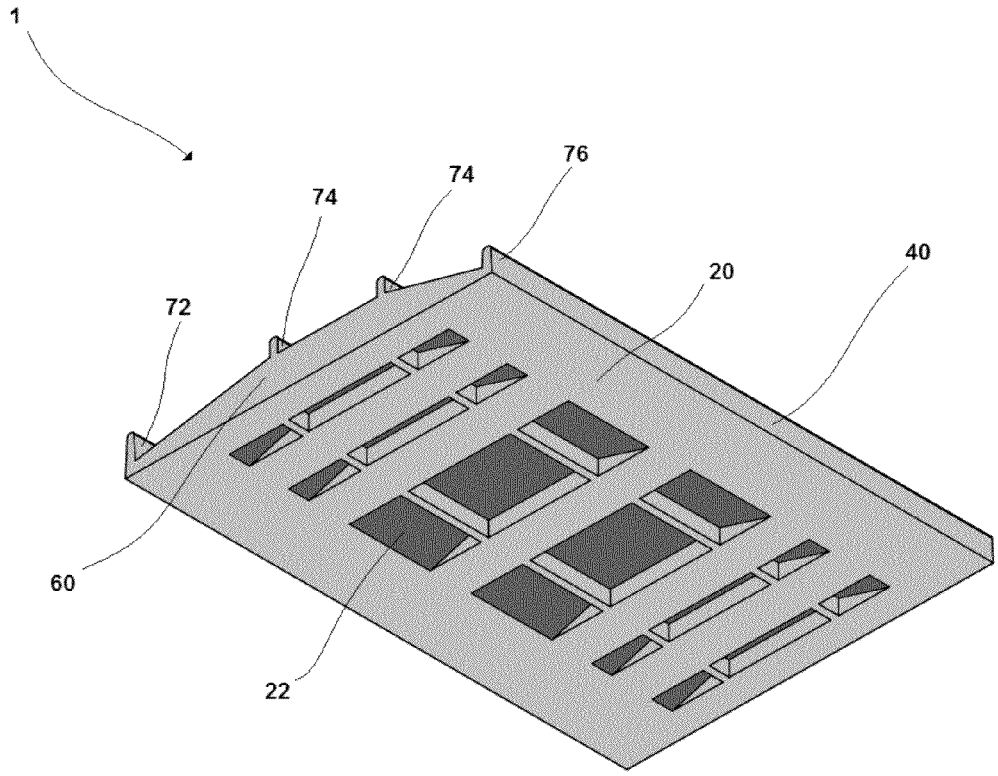
FIG. 6 is a perspective bottom view of the display member depicted in FIG. 1.

FIG. 1 shows a perspective view of one embodiment of a produce display stand 1. In this embodiment, the produce display stand 1 is a monolithic, flexible display member constructed entirely of a foam material, and having a top surface 10, a bottom surface 20, a front surface 30, a rear surface 40, a left surface 50, a right surface 60, and two or more divider panels 70. See FIGS. 1 and 6. Produce is placed onto the top surface 10 between and among the divider panels 70. The divider panels 70 hold the produce in place, thereby reducing the possibility that the produce will roll or slide off the produce display stand 1, while still allowing the produce to be visible and easily accessible. The produce display stand 1 is manufactured using a foam material. The foam may be open celled or closed celled. In the preferred embodiment the foam is closed cell, such as closed cell pvc foam. The foam construction cushions the produce and reduces bruising or other damage. Due to its foam construction, the produce display stand 1 is light weight, flexible, and fully immersible in water for easy cleaning and storage.

Figure 2:
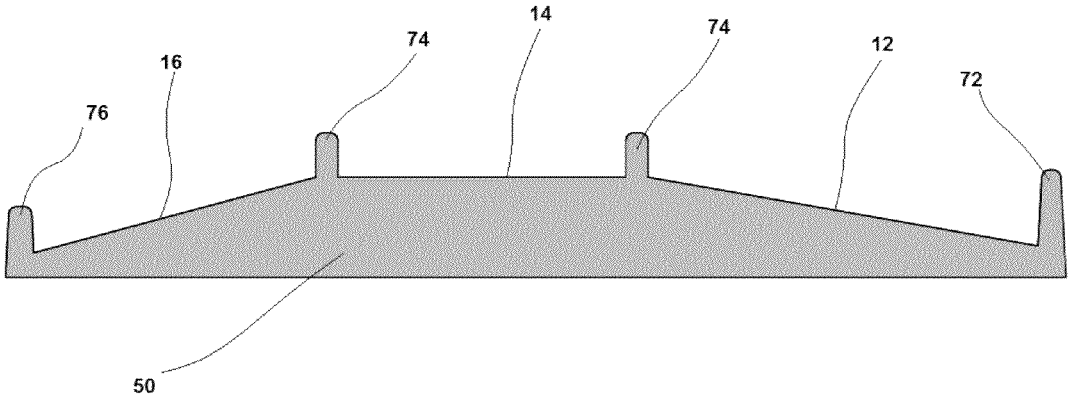
FIG. 2 is a plan side view of the display member depicted in FIG. 1. The opposite plan side view of the display member is substantially identical to FIG. 2.
Figure 3:
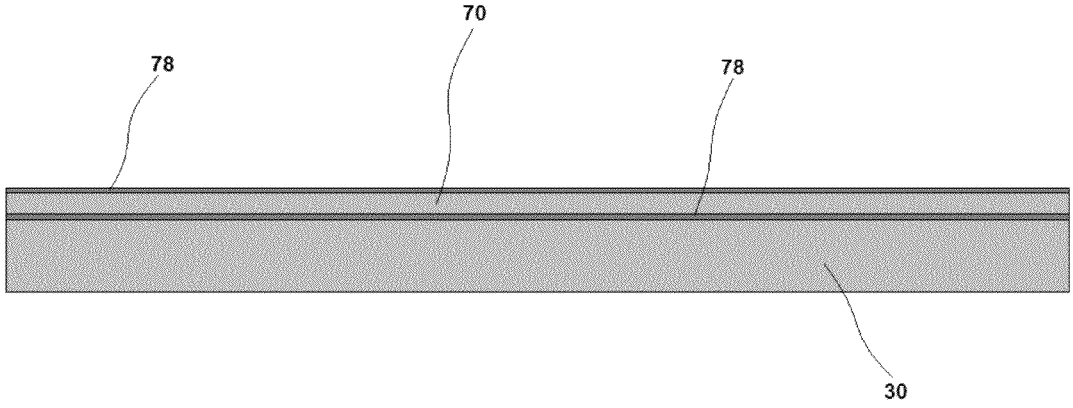
FIG. 3 is a plan front view of the display member depicted in FIG. 1. The plan rear view of the display member is substantially identical to FIG. 3.
Figure 4:
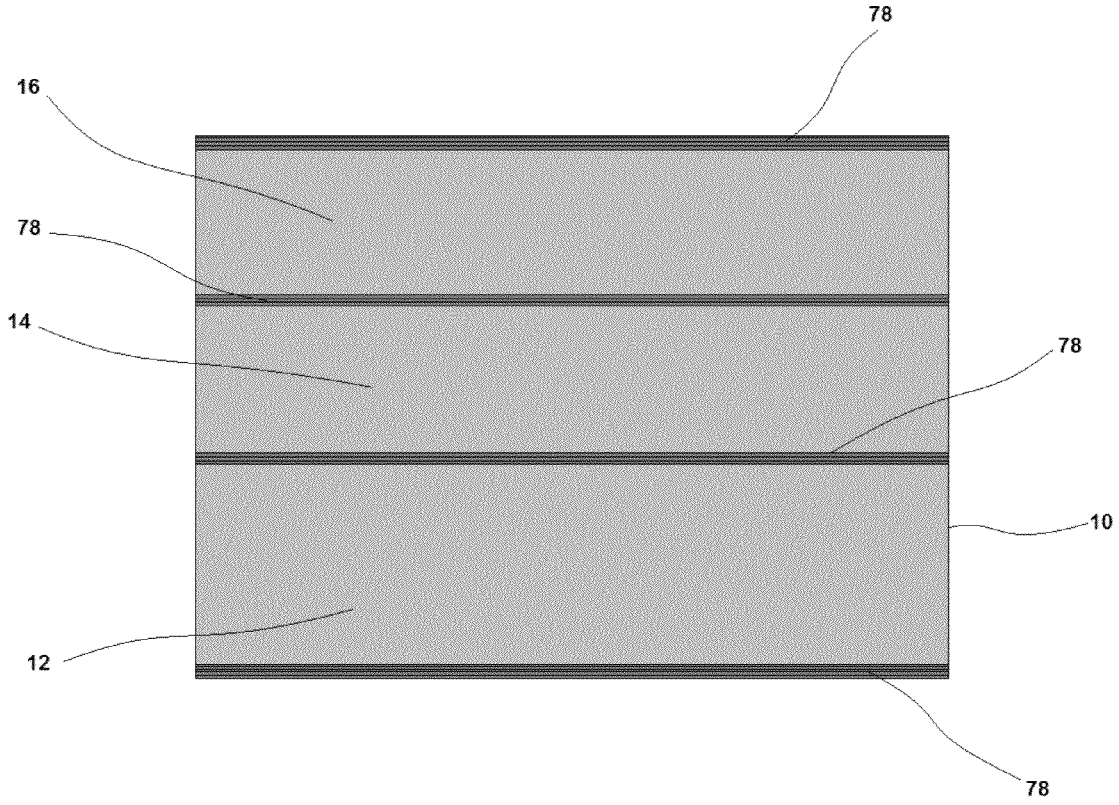
FIG. 4 is a plan top view of the display member depicted in FIG. 1.
Figure 5:
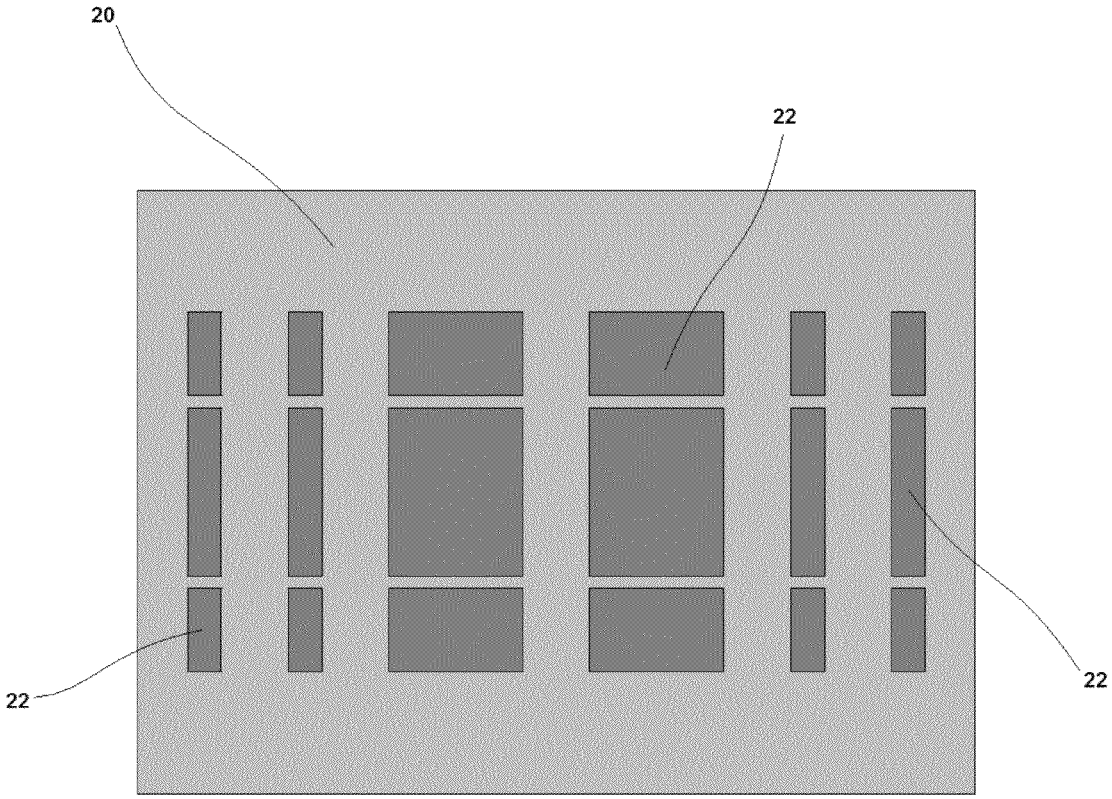
FIG. 5 is a plan bottom view of the display member depicted in FIG. 1.

The top surface 10 of the produce display stand 1 has a central region 14. See FIG. 4. The central region 14 is located between the front surface 30 and the rear surface 40. The top surface 10 is upwardly inclined from the front surface 30 towards the central region 14 of the top surface 10 and is upwardly inclined from the rear surface 40 towards the central region 14 of the top surface 10. See FIG. 2. As such, the produce display stand 1 has an elevated central region 14. This allows for a more full display of produce when produce is placed onto the top surface 10 of the produce display stand 1.

The bottom surface 20, the front surface 30, the rear surface 40, the left surface 50, and the right surface 60 are all substantially planar. See FIGS. 2, 3, 5, and 6. The top surface 10 is adjacent to the front surface 30, rear surface 40, left surface 50, and right surface 60. The bottom surface 20 is likewise adjacent to the front surface 30, rear surface 40, left surface 50, and right surface 60. The front surface 30 is further adjacent to the left surface 50 and the right surface 60. Similarly, the rear surface 40 is also adjacent to the left surface 50 and the right surface 60. In some embodiments, the front surface 30 is substantially parallel to the rear surface 40, and in other embodiments left surface 50 is substantially parallel to the right surface 60.

In some embodiments the front surface 30, rear surface 40, left surface 50, and right surface 60 may be oriented with respect to each other at angles other than right angles, thereby forming a produce display device 1 having an non-rectangular base shape. This allows for the produce display stand 1 to have a trapezoidal, rhomboidal, or irregular polygonal shape. In the preferred embodiments, however, the front surface 30 is substantially perpendicular to the left surface 50 and substantially perpendicular to the right surface 60, and the rear surface 40 is substantially perpendicular to the left surface 50 and substantially perpendicular to the right surface 60, thereby forming a rectangular produce display stand 1. See FIGS. 4 and 5.

Each of the divider panels 70 is elongate and extends upward from the top surface 10 of the produce display stand 1. See FIGS. 2 and 3. Each divider panel 70 is oriented substantially vertically and spaced apart from each other divider panel 70. Each divider panel 70 extends laterally from the left surface 50 towards the right surface 60. In some embodiments, each of the divider panels 70 is oriented substantially parallel to each other divider panel 70. In yet other embodiment each of the divider panels 70 is substantially the same width as each other divider panel 70 and substantially the same thickness as each other divider panel 70. In yet other embodiments the top edge 78 of each divider panel 70 is rounded. See FIG. 2. In the preferred embodiments the divider panels 70 exhibit all of these properties.

In a preferred embodiment the produce display stand 1 comprises four divider panels 70. See FIGS. 1 and 2. The front divider panel 72 is located substantially along a front edge of the produce display stand 1 contiguous with the front surface 30. The rear divider panel 76 is located substantially along a rear edge of the produce display stand 1 contiguous with the rear surface 40. The two center divider panels 74 are located between the front divider panel 72 and the rear divider panel 76, with each center divider panel 74 being spaced apart from the front and rear divider panels 72,76 and from the other center divider panel 74. In this embodiment each of the four divider panels 70 extends laterally from the left surface 50 to the right surface 60, each of the four divider panels 70 is oriented substantially parallel to each other divider panel 70, each of the four divider panels 70 is substantially the same width as each other divider panel 70, and each of the four divider panels 70 is substantially the same thickness as each other divider panel 70. See FIG. 4. So configured, the front divider panel 72 and the central divider panel 74 located nearest the front divider panel 72 define therebetween the front region 12 of the top surface 10, the rear divider panel 76 and the central divider panel 74 located nearest the rear divider panel 76 define therebetween the rear region 16 of the top surface 10, and the two central divider panels 74 define therebetween the central region 14 of the top surface 10. The front region 12 of the top surface 10 is upwardly inclined from the front divider panel 72 towards the center divider panel 74 located nearest the front divider panel 72 and the rear region 16 of the top surface 10 is upwardly inclined from the rear divider panel 76 towards the center divider panel 74 located nearest the rear divider panel 76. The central region 14 is oriented substantially horizontally.

In some embodiments the front region 12 of the top surface 10 is larger in area than the rear region 16 of the top surface 10. See FIG. 4. In other embodiments the front region 12 of the top surface 10 is larger in area than the central region 14 of the top surface 10. In yet other embodiments the front region 12 of the top surface 10 is larger in area than either the rear region 16 of the top surface 10 or the central region 14 of the top surface 10. In yet other embodiments the central region 14 of the top surface 10 is larger in area than either the front region 12 of the top surface 10 or the rear region 16 of the top surface 10. In yet other embodiments the front region 12 of the top surface 10, the central region 14 of the top surface 10, and the rear region 16 of the top surface 10 have substantially the same surface area.

In the preferred embodiments the front region 12 of the top surface 10, the central region 14 of the top surface 10, and the rear region 16 of the top surface 10 are each substantially planar. See FIG. 2. In other embodiments the front region 12 of the top surface 10, the central region 14 of the top surface 10, and the rear region 16 of the top surface 10 are each curved smoothly upward.

In other embodiments of the produce display stand 1 there may be more than two central divider panels 76, defining multiple central regions 14 of the top surface 10. In such embodiments having an even number of central regions 14, each of the central regions 14 may be upwardly inclined towards the center of the produce display stand 1. In such embodiments having an odd number of central regions 14, the center most central region 14 may be oriented substantially horizontally and each of the remaining central regions 14 may be upwardly inclined towards the center of the produce display stand 1.

The produce display stand 1 may, in some embodiments, have one or more cavities 22 formed into its bottom surface 20. See FIGS. 5 and 6. The cavities 22 can be of any shape and size, and where multiple cavities 22 are used each may have a shape and size different from other cavities 22. No cavity 22, however, may penetrate completely through the produce display stand 1, thereby preserving the integrity of the top surface 10. The cavities 22 serve to lighted the overall weight of the produce display stand 1, make it easier to be flexed and even be rolled up, and save on manufacturing materials costs. Where the produce display stand 1 is placed onto an inclined table or counter top, the cavities 22 may be placed over pegs or other appendages extending upwardly from the inclined surface, thereby preventing the produce display stand 1 from sliding off the inclined surface.

The produce display stand 1 may be of varied size. In one embodiment, its dimensions are between forty inches (101.6 cm) and fifty inches (127 cm) wide, as measured from left surface 50 to the right surface 60, between forty inches (101.6 cm) and fifty-five inches (139.7 cm) deep, as measured from front surface 30 to the rear surface 40, and between four inches (40.2 cm) and six inches (15.2 cm) high, as measured from bottom surface 20 to the highest point of the top surface 10.

The produce display stand 1 may be manufactured using compression molding technology. It is created out of a foam material, such as closed cell pvc foam. A liquid mixture of closed cell foam material is first created. Then the liquid mixture is placed into a mold through an aperture in the mold. The liquid mixture within the mold is heated under pressure until the liquid mixture expands and completely fills mold and solidifies. The resulting solid material is removed from the mold and cooled. During cooling, the solid material expands to its desired final size.

Among the advantages of the produce display stand 1 are the following: The produce display stand 1 holds produce securely and safely while also providing a visually appealing display. The produce display stand's 1 monolithic design simplifies the manufacturing process and increases manufacturing efficiency. The monolithic design, coupled with its foam material construction, eliminates the need for multiple parts and provides a surface substantially impervious to water, mold, bacteria, or other organic compounds. When closed cell foam is used, its properties also provide the benefit that, should a surface of the produce display stand 1 sustain a cut or have a portion broken off, the inner surface of the cut or break will retain the same properties as the unbroken surface. In addition, because the invention is made of a foam material, it provides greater protection against bruising or damage. That is, if a surface of the produce display stand 1 is damaged, the underlying material has the same cushioning properties as the surface. Thus, the produce is protected even if the produce display stand 1 is damaged.

The invention is not limited to what is described in the foregoing embodiments. For example, although a produce display stand 1 is described in detail, the principles described herein may be used in the construction and manufacture of any type of stand for displaying other types of perishable and/or damageable goods.

Other embodiments not specifically set forth herein are also within the scope of the following claims, whereby modifications and variations can be made to the disclosed embodiments of the method of the present invention without departing from the subject or spirit of the invention as defined in the following claims.

What is claimed:

1. A device for displaying produce, comprising:

a monolithic, flexible display member constructed entirely of a foam material, and having a top surface, a bottom surface, a front surface, a rear surface, a left surface, a right surface, and four divider panels;

with the top surface having a central region, a front region, and a rear region, said top surface being adjacent to the front, rear, left, and right surfaces, said front region of the top surface located between the front surface and the central region and being upwardly inclined from the front surface towards the central region of the top surface, said rear region of the top surface located between the rear surface and the central region and being upwardly inclined from the rear surface towards the central region of the top surface, and said central region of the top surface located between the front surface and the rear surface and being oriented substantially horizontally, the bottom surface being substantially planar, said bottom surface being adjacent to the front, rear, left, and right surfaces, the front surface being substantially planar, said front surface being adjacent to left and right surfaces, the rear surface being substantially planar, said rear surface being adjacent to the left and right surfaces, the left surface being substantially planar, and the right surface being substantially planar;

with each of the four divider panels being elongate and extending upward from the top surface, each said divider panel being oriented substantially vertically and spaced apart from each other divider panel, wherein one of the four divider panels is a front divider panel, one of the four divider panels is a rear divider panel, and the remaining two divider panels are center divider panels, with the front divider panel located substantially along a front edge of the display member contiguous with the front surface, the rear divider panel located substantially along a rear edge of the display member contiguous with the rear surface, and the two center divider panels located between the front divider panel and the rear divider panel each center divider panel being spaced apart from the front and rear divider panels and from the other center divider panel, with each of the four divider panels extending laterally from the left surface to the right surface each of the four divider panels oriented substantially parallel to each other divider panel, each of the four divider panels substantially the same width as each other divider panel, and each of the four divider panels substantially the same thickness as each other divider panel;

with said central region of the top surface located between the two central divider panels, said front region of the top surface located between the front divider panel and the central divider panel located nearest the front divider panel, and said rear region of the top surface located between the rear divider panel and the central divider panel located nearest the rear divider panel.

2. The device of claim 1 wherein the front region of the top surface is larger in area than the rear region of the top surface.

3. The device of claim 1 wherein the front region of the top surface is larger in area than the central region of the top surface.

4. The device of claim 1 wherein the front region of the top surface is substantially planar, the central region of the top surface is substantially planar, and the rear region of the top surface is substantially planar.

5. The device of claim 1 wherein the front region of the top surface is curved smoothly upward, the central region of the top surface is curved smoothly upward, and the rear region of the top surface is curved smoothly upward.

6. A device for displaying produce, comprising:

a monolithic, flexible display member constructed entirely of a closed cell foam material, and having a top surface, a bottom surface, a front surface, a rear surface, a left surface, a right surface, a front divider panel, a rear divider panel, a first central divider panel, and a second central divider panel, with the top surface being adjacent to the front, rear, left, and right surfaces, the bottom surface being substantially planar and having a plurality of cavities formed into it, said bottom surface being adjacent to the front, rear, left, and right surfaces, the front surface being substantially planar, said front surface being adjacent to left and right surfaces, the rear surface being substantially planar, said rear surface being adjacent to the left and right surfaces, the left surface being substantially planar and substantially perpendicular to the bottom surface, to the front surface, and to the rear surface, the right surface being substantially planar and substantially perpendicular to the bottom surface, to the front surface, and to the rear surface, and each of the divider panels is elongate and extends upward from the top surface, each said divider panel being oriented substantially vertically and spaced apart from each other divider panel, each of the four divider panels extends laterally from the left surface to the right surface, each of the four divider panels is oriented substantially parallel to each other divider panel, each of the four divider panels is substantially the same width as each other divider panel, each of the four divider panels is substantially the same thickness as each other divider panel, and each of the four divider panels has a rounded top edge, with the front divider panel located substantially along a front edge of the display member contiguous with the front surface, the rear divider panel located substantially along a rear edge of the display member contiguous with the rear surface, the first central divider panel located between the front divider panel and the second central divider panel, and the second central divider panel located between the rear divider panel and the first central divider panel, wherein a front region of the top surface is located between the front divider panel and the first central divider panel, a rear region of the top surface is located between the rear divider panel and the second central divider panel, and a central region of the top surface is located between the two central divider panels, with the front region of the top surface being substantially planar and upwardly inclined from the front divider panel towards the first center divider panel, the rear region of the top surface being substantially planar and upwardly inclined from the rear divider panel towards the second center divider panel, and the central region being substantially planar and oriented substantially horizontally, and the front region of the top surface being larger in area than either the rear region of the top surface or the central region of the top surface.

* * * * *